US010029810B2

(12) United States Patent
Wegman

(10) Patent No.: US 10,029,810 B2
(45) Date of Patent: Jul. 24, 2018

(54) SINGLE DOSE SCREENING FOR PARTICULATE MATERIALS

(71) Applicant: Xerox Corporation, Norwalk, CT (US)

(72) Inventor: Paul M. Wegman, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 65 days.

(21) Appl. No.: 15/145,074

(22) Filed: May 3, 2016

(65) Prior Publication Data

US 2017/0137154 A1 May 18, 2017

Related U.S. Application Data

(60) Provisional application No. 62/255,507, filed on Nov. 15, 2015.

(51) Int. Cl.

| | |
|---|---|
| ***B65B 1/08*** | (2006.01) |
| ***B65B 39/00*** | (2006.01) |
| *G03G 15/08* | (2006.01) |

(52) U.S. Cl.

CPC ..... *B65B 1/08* (2013.01); *B65B 39/007* (2013.01); *G03G 15/0879* (2013.01); *B65B 2039/008* (2013.01); *B65B 2210/10* (2013.01); *G03G 15/0894* (2013.01)

(58) Field of Classification Search

CPC ..... B65B 1/08; B65B 2210/10; B65B 39/007
USPC ..... 141/72, 75; 222/161, 196, 198
See application file for complete search history.

(56) References Cited

U.S. PATENT DOCUMENTS

| | | | | | |
|---|---|---|---|---|---|
| 2,815,135 | A | * | 12/1957 | Kullmar | C03B 3/00 198/771 |
| 2,953,282 | A | * | 9/1960 | Peterson | B06B 1/167 222/196 |
| 3,078,685 | A | * | 2/1963 | Flournoy | F17C 5/00 141/59 |
| 3,232,494 | A | * | 2/1966 | Poarch | F16K 3/06 137/575 |
| 3,248,018 | A | * | 4/1966 | Fleischman | B65G 69/181 222/196 |
| 3,259,272 | A | * | 7/1966 | Larson | B01J 8/003 222/1 |
| 3,490,655 | A | * | 1/1970 | Ledgett | B01F 5/243 222/196 |
| 3,945,814 | A | * | 3/1976 | Keib | C03B 37/085 65/540 |
| 4,393,292 | A | * | 7/1983 | Inoue | B23H 1/02 219/69.14 |

(Continued)

*Primary Examiner* — Timothy L Maust
(74) *Attorney, Agent, or Firm* — Simpson & Simpson, PLLC

(57) ABSTRACT

A system for transferring a particulate material from a first container to a second container including an upper portion, a lower portion and a sieve. The upper portion having a housing and a high frequency vibrator, the housing having a first end, a second end opposite the first end, and a gasket positioned adjacent the first end. The lower portion having a collector funnel, a low frequency vibrator and a collar securing the low frequency vibrator to the collector funnel. The sieve having a mesh size, a perimeter and a gasket positioned adjacent the perimeter. The upper portion is releasably secured to the first container and the sieve is releasably secured between the second end of the upper portion and the lower portion.

9 Claims, 8 Drawing Sheets

(56) References Cited

U.S. PATENT DOCUMENTS

| | | | | | |
|---|---|---|---|---|---|
| 4,688,610 | A * | 8/1987 | Campbell | B65B 1/34 | 141/120 |
| 4,776,493 | A * | 10/1988 | Tegel | B65D 90/626 | 222/196 |
| 5,474,609 | A * | 12/1995 | Mulder | B05B 5/032 | 118/308 |
| 6,488,181 | B1 * | 12/2002 | Schuller | B65G 65/44 | 141/1 |
| 8,876,027 | B2 * | 11/2014 | Oehr | B02C 17/20 | 241/1 |
| 9,637,250 | B2 * | 5/2017 | Biason | B65B 1/08 | |
| 2008/0187423 | A1 * | 8/2008 | Mauchle | B05B 7/1454 | 414/415 |
| 2013/0082073 | A1 * | 4/2013 | Eversole | B25D 11/106 | 222/196 |

* cited by examiner

SINGLE DOSE SCREENING FOR PARTICULATE MATERIALS

CROSS-REFERENCE TO RELATED APPLICATIONS

This patent application claims the benefit under 35 U.S.C. § 119(e) of U.S. Provisional Patent Application No. 62/255,507, filed Nov. 15, 2015, which application is incorporated herein by reference.

TECHNICAL FIELD

The presently disclosed embodiments are directed to providing an apparatus for handling a particulate material, more particularly to handling a fine particulate material, and even more particularly to handling a fine particulate material to prevent the formation of agglomerates and to prevent the transfer of agglomerates from one container to another.

BACKGROUND

Fine particulate materials, and in particular ultra-fine particles, often become agglomerated during packaging, transport, storage, subsequent handling, etc. Agglomeration can occur for a variety of reasons, e.g., humidity, temperature, pressure. Agglomerations of particulate materials may have detrimental effects on subsequent uses of those materials. For example, agglomerates of xerographic developer material, i.e., a mixture of a carrier and toner particles, can cause banding or streaking when used in a xerographic printing device.

Agglomeration of particulate materials was found to be particularly troublesome when transporting large containers over long distances. For example, xerographic developer material is packaged in bulk in barrels and transported from the United States to India. During transport, the materials are exposed to varying levels of heat and pressure. Agglomeration often occurs resulting in print quality defects when using those materials. Although decreasing the size of shipping containers decreases the occurrences of agglomeration, it increases packaging and shipping costs.

In addition to forming agglomerated materials during transport, repackaging particulate materials may also form agglomerates. For example, after transport to its destination, developer material must be transferred from the shipping containers, e.g., barrels or buckets, to xerographic replaceable units (XRUs), cartridges or other containers. Known system 50 is an example of a device used to transfer developer material from a bulk transport or storage container 54 to XRU 52. Particulate material 56, e.g., xerographic developer material, is passed from bulk container 54 to hopper 58. Agitator motor 60 drives one or more agitators disposed within hopper 58, e.g., central agitator 62 and/or edge agitator 64. Agitators 62 and 64 to assist developer material 56 to remain evenly distributed within hopper 58 while auger 66 pushes or draws developer material 56 from hopper 58. Developer material 56 exits hopper 58 through reduced region 68 with assistance from auger 66 and falls against spinning disc 70. Spinning disc 70 imparts a centrifugal force on developer material 56 thereby throwing developer material 56 outwardly as it enters lower funnel 72. Developer material 56 then passes through reduced region 74 to neck 76 and subsequently into cartridge 52. It has been found that the foregoing arrangement results in the formation of some agglomerates, possibly due to heat and pressure generated by the interaction of auger 66 with developer material 56 within reduced region 68. As described above, the formation of agglomerates results in undesirable printing defects when a toner cartridge containing those agglomerates is used.

The present disclosure addresses a system that minimizes and/or eliminates the formation of agglomerates during transfer and packaging of particulate materials.

SUMMARY

The present disclosure sets forth a device that is attached to an automatic filling system that allows a single dose of particulate material dispensed from a filler auger to be screened immediately prior to entering a container to which it is intended, e.g., an XRU, a cartridge or other suitable container. The screening operation assures that any agglomerates formed during transport or other handling of the particulate material, whether from processing, shipping, transfer, residing or subjected to the filling process, are removed so as to not contaminate the filled container. The present system maintains acceptable quality of the particulate material, thereby providing acceptable functionality from the particulate material, e.g., acceptable xerographic printing performance.

Broadly, the present disclosure describes a system for transferring a particulate material from a first container to a second container including an upper portion, a lower portion and a sieve. The upper portion includes a housing and a high frequency vibrator, the housing includes a first end, a second end opposite the first end, and a gasket positioned adjacent the first end. The lower portion includes a collector funnel, a low frequency vibrator and a collar securing the low frequency vibrator to the collector funnel. The sieve includes a mesh size, a perimeter and a gasket positioned adjacent the perimeter. The upper portion is releasably secured to the first container and the sieve is releasably secured between the second end of the upper portion and the lower portion.

Additionally, the present disclosure broadly describes a method of transferring a particulate material from a first container to a second container using a system. The system includes an upper portion, a lower portion and a sieve. The upper portion includes a housing and a high frequency vibrator, the housing includes a first end, a second end opposite the first end, and a gasket positioned adjacent the first end. The lower portion includes a collector funnel, a low frequency vibrator and a collar securing the low frequency vibrator to the collector funnel. The sieve includes a mesh size, a perimeter and a gasket positioned adjacent the perimeter. The upper portion is releasably secured to the first container and the sieve is releasably secured between the second end of the upper portion and the lower portion. The method includes: a) moving the particulate material to the upper portion from the first container; b) vibrating the upper portion with the high frequency vibrator and the lower portion with the low frequency vibrator; c) passing the particulate material through the sieve to the lower portion; and, d) moving the particulate material from the lower portion to the second container.

Other objects, features and advantages of one or more embodiments will be readily appreciable from the following detailed description and from the accompanying drawings and claims.

BRIEF DESCRIPTION OF THE DRAWINGS

Various embodiments are disclosed, by way of example only, with reference to the accompanying drawings in which corresponding reference symbols indicate corresponding parts, in which.

DETAILED DESCRIPTION

Figure 1:
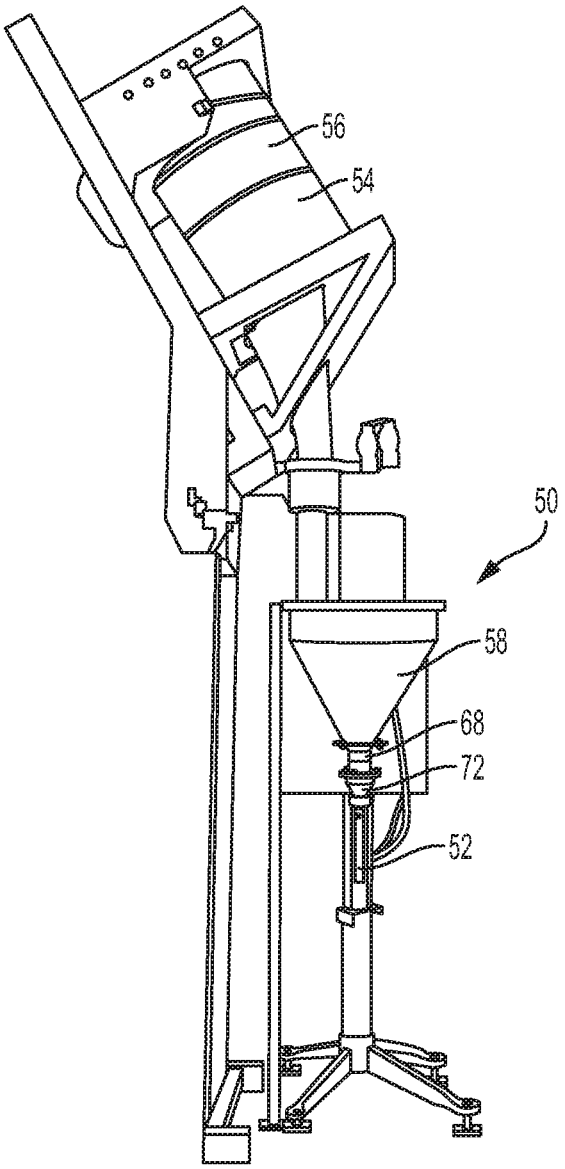
FIG. 1 PRIOR ART
FIG. 1 is a perspective view of a known system for transferring particulate material from a bulk container to a xerographic replaceable unit.
Figure 2:
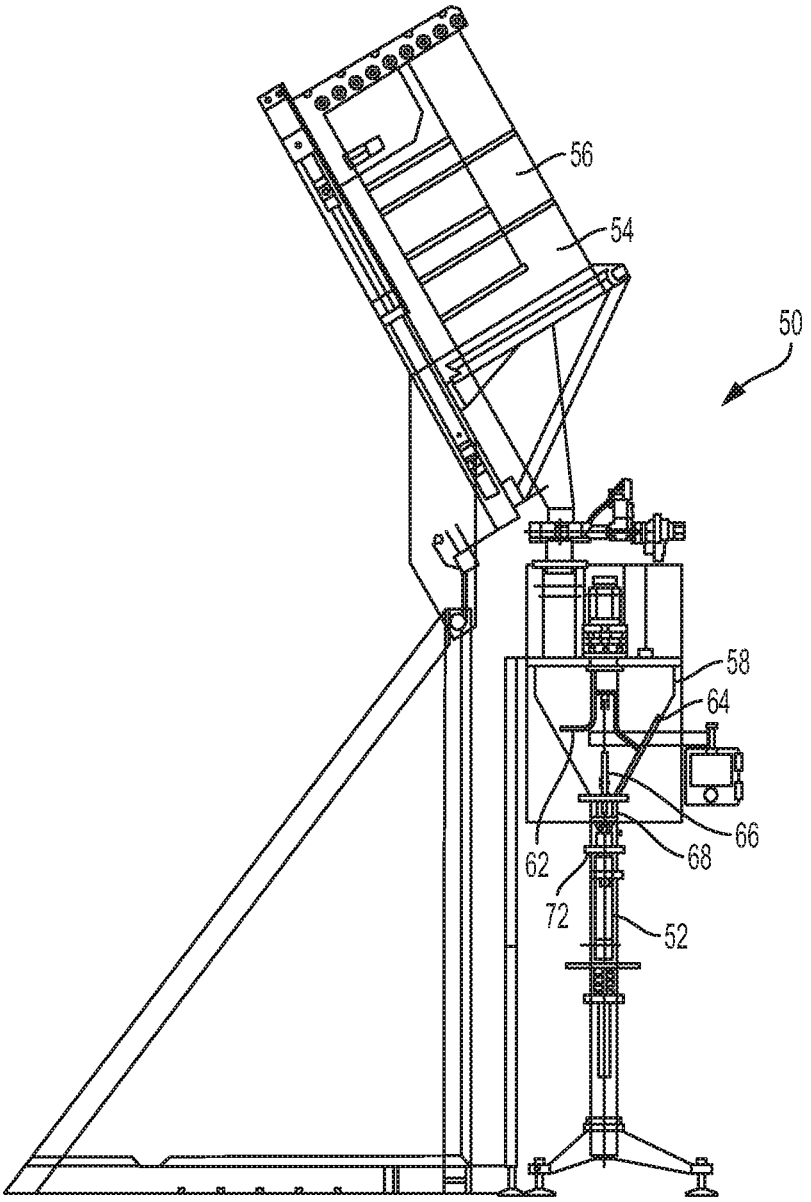
FIG. 2 PRIOR ART
FIG. 2 is a side elevational view with partial cross sectional view of the system for transferring particulate material from a bulk container to a xerographic replaceable unit shown in FIG. 1.
Figure 3:
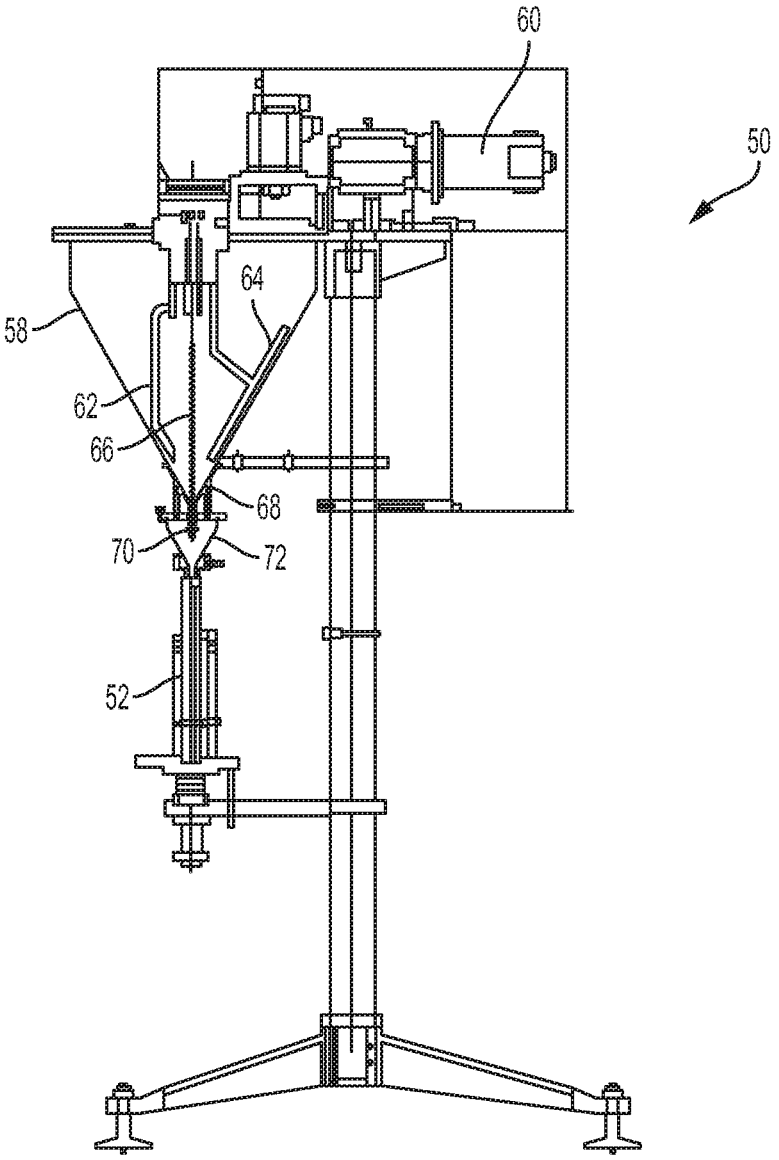
FIG. 3 PRIOR ART
FIG. 3 is a side elevational view with partial cross sectional view of another embodiment of a known system for transferring particulate material from a bulk container to a xerographic replaceable unit.
Figure 4:
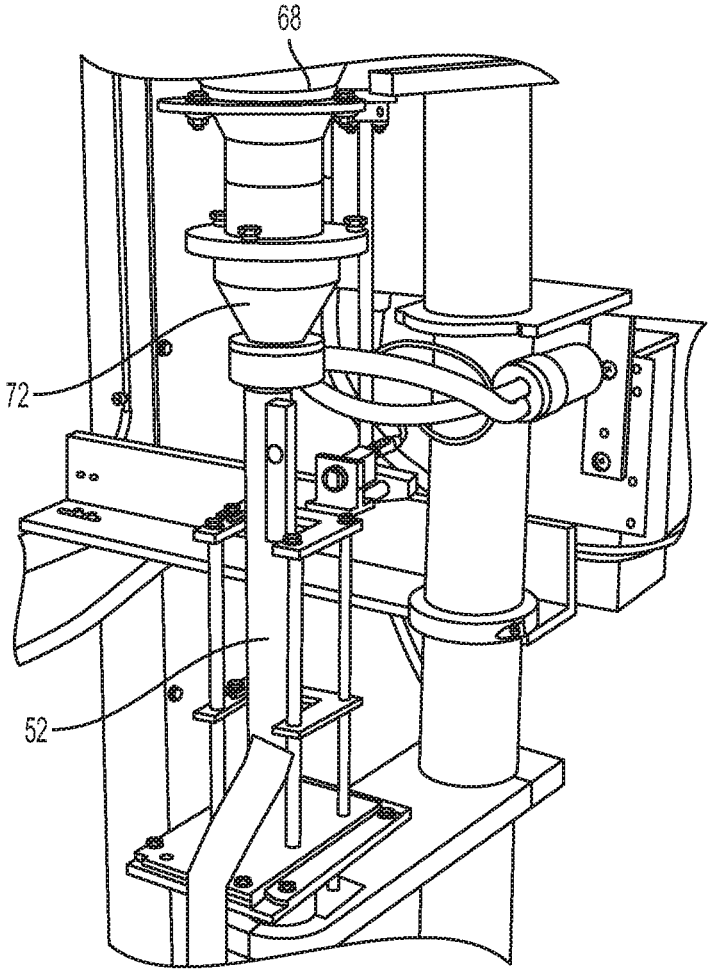
FIG. 4 PRIOR ART
FIG. 4 is an enlarged portion of the known system for transferring particulate material from a bulk container to a xerographic replaceable unit shown in FIG. 1 depicting the final filling stage.
Figure 5:
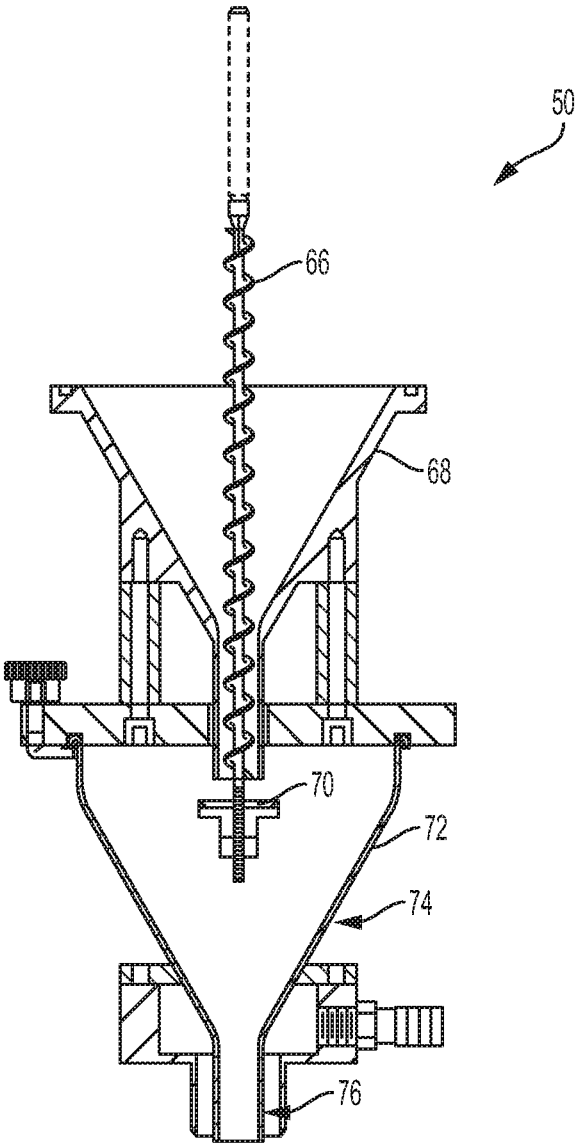
FIG. 5 PRIOR ART
FIG. 5 is a cross sectional view of another embodiment of a known system for transferring particulate material from a bulk container to a xerographic replaceable unit depicting a portion of the system from the bottom of the hopper to the collector funnel.
Figure 6:
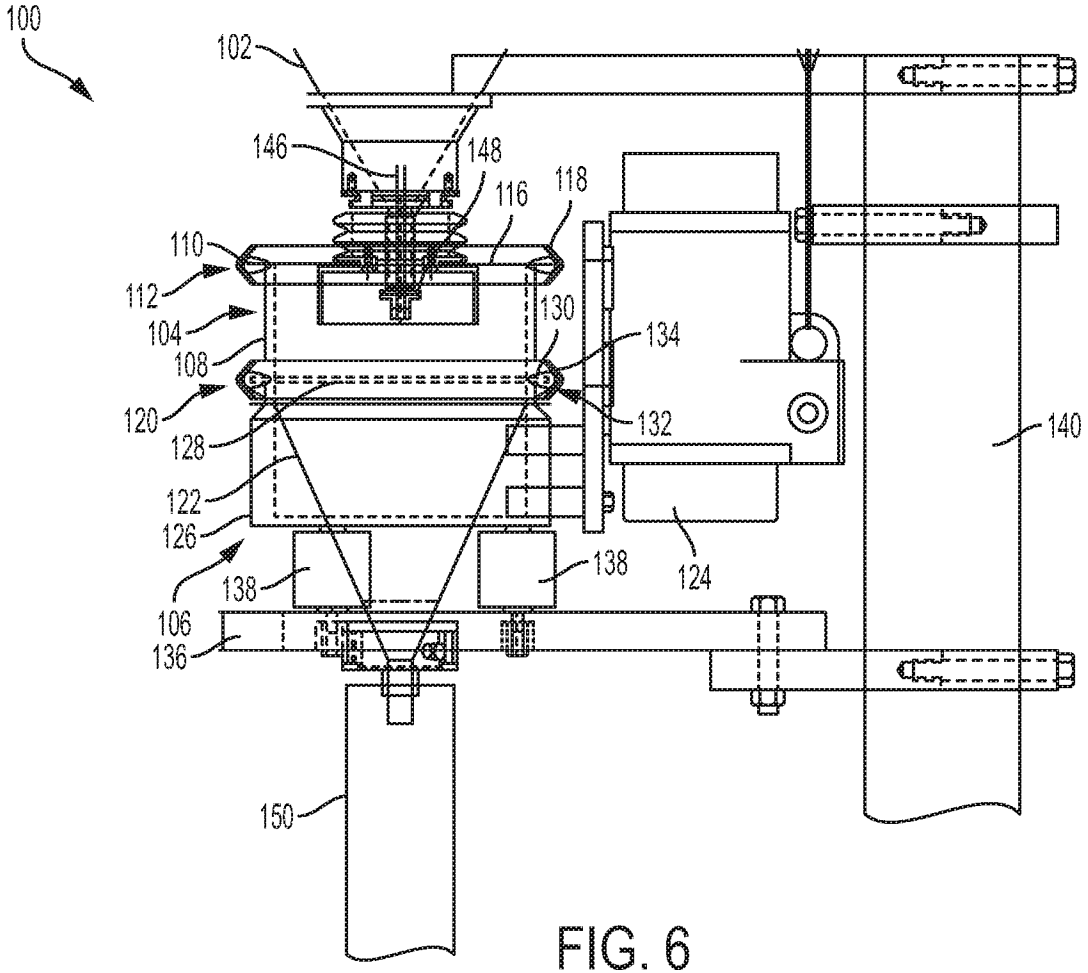
FIG. 6 is a side elevational view with partial cross sectional view of an embodiment of a present system for transferring particulate material from a bulk container to a xerographic replaceable unit depicting a portion of the system from the bottom of the hopper to the collector funnel and showing some internal components in broken lines.
Figure 7:
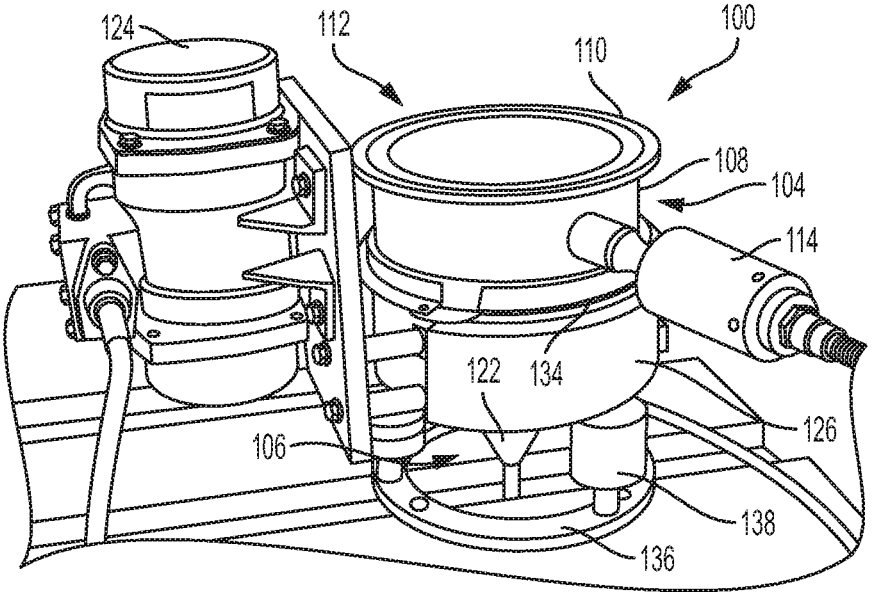
FIG. 7 is a perspective view of another embodiment of a present system for transferring particulate material from a bulk container to a xerographic replaceable unit depicting a portion of the system from the bottom of the hopper to the collector funnel.
Figure 8:
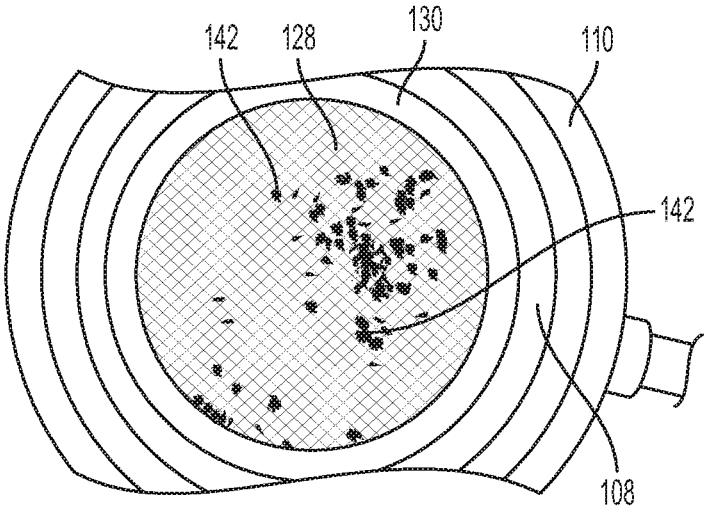
FIG. 8 is a top perspective view of an embodiment of a sieve used in a present system for transferring particulate material from a bulk container to a xerographic replaceable unit; and, FIG. 9 is a perspective view of another embodiment of a present system for transferring particulate material from a bulk container to a xerographic replaceable unit depicting a portion of the system from the bottom of the hopper to the collector funnel and a conveyor for positioning containers to be filled with particulate material below the present system.
Figure 9:
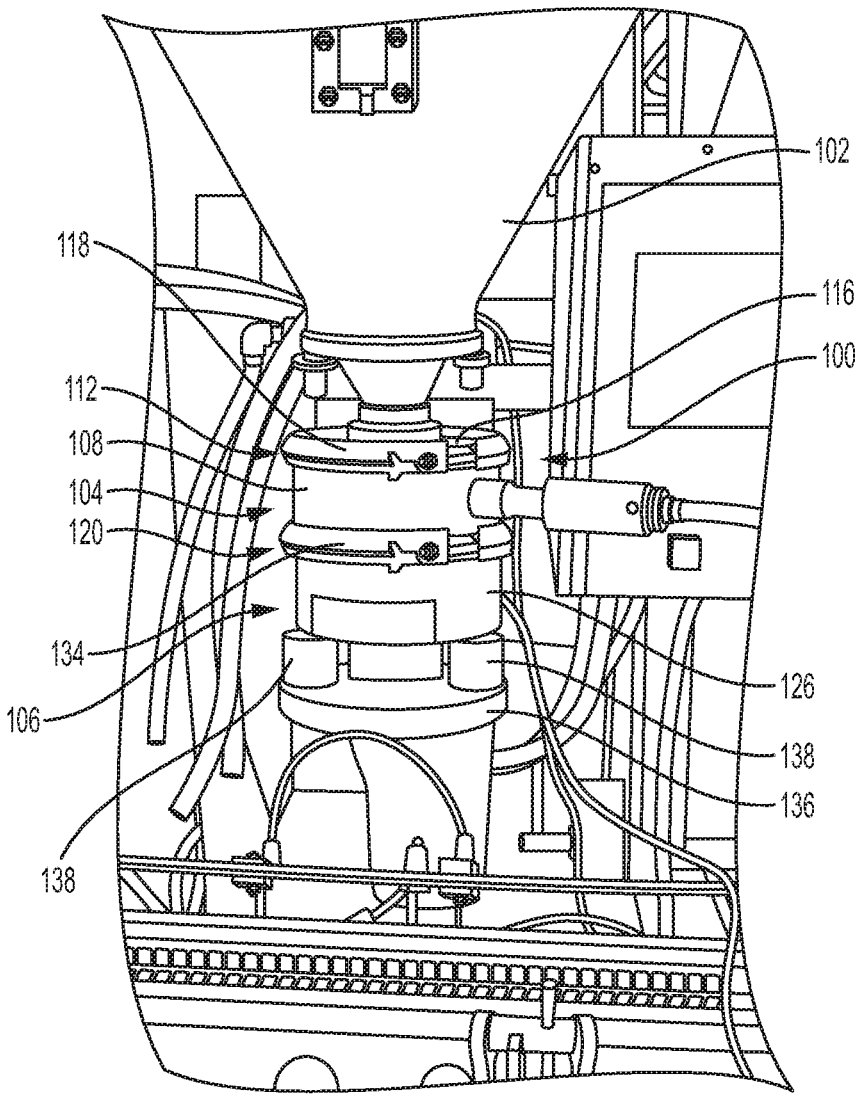

At the outset, it should be appreciated that like drawing numbers on different drawing views identify identical, or functionally similar, structural elements of the embodiments set forth herein. Furthermore, it is understood that these embodiments are not limited to the particular methodology, materials and modifications described and as such may, of course, vary. It is also understood that the terminology used herein is for the purpose of describing particular aspects only, and is not intended to limit the scope of the disclosed embodiments, which are limited only by the appended claims.

Unless defined otherwise, all technical and scientific terms used herein have the same meaning as commonly understood to one of ordinary skill in the art to which these embodiments belong. It should be understood that the use of "or" in the present application is with respect to a "non-exclusive" arrangement, unless stated otherwise. For example, when saying that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Furthermore, as used herein, the term 'average' shall be construed broadly to include any calculation in which a result datum or decision is obtained based on a plurality of input data, which can include but is not limited to, weighted averages, yes or no decisions based on rolling inputs, etc. As used herein, "high frequency" or "ultra-high frequency" is intended to mean frequencies above 20,000 Hz typically, with a preferred but non-limiting range between 20,000-40,000 Hz, while "low frequency" is intended to mean frequencies below 120 Hz typically, with a preferred but non-limiting range between 1-120 Hz.

Moreover, although any methods, devices or materials similar or equivalent to those described herein can be used in the practice or testing of these embodiments, some embodiments of methods, devices, and materials are now described.

Broadly, the present system provides a means for transferring particulate material from a bulk container to XRUs, cartridges or other suitable containers. System 100, which is positioned below hopper 102, includes upper portion 104 and lower portion 106. Upper portion 104 includes cylindrical housing 108 having gasket seal 110 secured at first end 112. Vibrator 114 is attached to cylindrical housing 108 and imparts higher frequency vibrations to housing 108 and thereby to system 100. Vibrator 114 may be an ultra-high frequency vibration transducer such as a piezo-electric element, or any other means known in the art for imparting ultra-high frequency vibration. First end 112 is secured to hopper 102 at cover plate 116 with clamp 118. Second end 120 is secured to lower portion 106.

Lower portion 106 includes collector funnel 122, vibrator 124 and collar 126 which secures vibrator 124 to collector funnel 122. Vibrator 124 imparts lower frequency vibrations to collar 126 and collector funnel 122, and thereby to system 100. Vibrator 124 may be a low frequency vibrator such as a motor spinning an eccentric mass, or any other means known in the art for imparting low frequency vibration.

Sieve 128 is positioned between upper portion 104 and lower portion 106. Sieve 128 includes gasket seal 130 about outer circumferential edge 132. Clamp 134 secures sieve 128 to both upper portion 104 and lower portion 106, while gasket 130 provides a seal therebetween. Sieve 128 may be constructed from any suitable material, such as stainless steel, aluminum, etc. Sieve 128 must have a mesh size sufficient to permit passage of discreet developer material particles while blocking passage of agglomerates. In short, the size of mesh used in sieve 128 is dependent on the size of individual particulate size being passed though system 100. It should be appreciated that average sizes of toner particles or developer material particles, in some embodiments, can range between 8-10 micrometers; however, it is also possible to use system 100 with larger and small particle sizes by changing the mesh size of sieve 128.

Collar 126 is secured to mount 136 via vibration isolators 138. Mount 136 secures system 100 to main support column 140, while vibration isolators 138 prevent vibration of system 100 from being transmitted to main support column 140. Vibration isolators 138 may be formed from an elastomeric material or any other suitable material that minimizes or eliminates vibration transmission.

Particulate material 142, e.g., xerographic developer material, is transferred from bulk container 144 to hopper 102. As described above, material 142 is moved from hopper 102 via auger 146 and spinning disc 148 to upper portion 104. The combination of low and high frequency vibrations provided by vibrators 114 and 124 cause material 142 to pass through sieve 128 without permitting the passage of agglomerated material. Moreover, the combination also assists with the passage of material 142 through sieve 128 as it has been found to increase the rate of passage. It is believed that the high and low frequency vibrations also aid in the separation of agglomerates formed in accordance with the description above. For example, the high frequency vibrations cause agglomerates to move up/down and side/side thereby impacting and/or abrading agglomerates against sieve 128. The impacting and/or abrading cause discrete particles to break free of the agglomerates thereby permitting passage through sieve 128. Subsequently, collector funnel 122 transfers material 142 to container 150, e.g., an XRU. Thus, present system prevents the transfer of agglomerated particulate materials from a bulk container to a cartridge, a replaceable unit or other smaller container.

The present system includes a variety of components which each contribute to the overall performance of the system. Some components include but are limited to a screen and two separate and independent vibration sources. Both vibration sources combined provide vibration from very low to ultra-high frequencies tuned to allow rapid movement of particulate material through the screen. In other terms, the combination of low and high frequencies may be tuned to provide the desired ratio of material transfer across a sieve. Thus, the combination of particle size, sieve/mesh size and vibration frequencies results in a particular rate of material transfer through the sieve, i.e., a specific combination may be tuned to a desired material transfer rate by varying any one of the foregoing variables.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A method of transferring a particulate material from a first container to a second container using a system comprising an upper portion, a lower portion and a sieve, the upper portion comprising a housing and a high frequency vibrator, the housing comprising a first end, a second end opposite the first end, and a gasket positioned adjacent the first end, the lower portion comprising a collector funnel, a low frequency vibrator and a collar securing the low frequency vibrator to the collector funnel, and the sieve comprising a perimeter and a gasket positioned adjacent the perimeter, wherein the upper portion is adapted to be releasably secured to the first container and the sieve is releasably secured between the second end of the upper portion and the lower portion, the method comprising:

a) moving the particulate material to the upper portion from the first container;

b) vibrating the upper portion with the high frequency vibrator and the lower portion with the low frequency vibrator;

c) passing the particulate material through the sieve to the lower portion; and, d) moving the particulate material from the lower portion to the second container.

2. The method of claim 1 wherein the first container is connected to a hopper and the system further comprises a first clamp for releasably securing the first end of the upper portion to the hopper.

3. The method of claim 1 wherein the system further comprises a second clamp for releasably securing the sieve between the second end of the upper portion and the lower portion.

4. The method of claim 1 wherein the system further comprises a mount and at least one vibration isolator connecting the mount to the collar, wherein the mount releasably secures the system to a main support column.

5. The method of claim 1 wherein the sieve comprises a mesh size, the particulate material comprises a plurality of discrete particles and a plurality of agglomerated particles, and the mesh size is selected to permit the passage of the plurality of discrete particles.

6. The method of claim 1 wherein the high frequency vibrator generates vibrations above 20,000 Hz.

7. The method of claim 6 wherein the high frequency vibrator generates vibrations between 20,000 Hz and 40,000 Hz.

8. The method of claim 1 wherein the low frequency vibrator generates vibrations below 120 Hz.

9. The method of claim 8 wherein the low frequency vibrator generates vibrations between 1 Hz and 120 Hz.

* * * * *